US005674087A

United States Patent [19]

Kirma

[11] Patent Number: 5,674,087

[45] Date of Patent: Oct. 7, 1997

[54] SCREW-TYPE COUPLING MEMBER WITH ROTATION LOCK

[75] Inventor: Safa Kirma, Holstein, Germany

[73] Assignee: Daimler-Benz Aerospace Airbus GmbH, Hamburg, Germany

[21] Appl. No.: 621,826

[22] Filed: Mar. 22, 1996

[30] Foreign Application Priority Data

Mar. 23, 1995 [DE] Germany ..... 195 10 521.4

[51] Int. Cl.[6] ..... H01R 4/38

[52] U.S. Cl. ..... 439/321

[58] Field of Search ..... 439/320–323, 439/315, 318; 285/81, 82, 85, 86, 89, 92

[56] References Cited

U.S. PATENT DOCUMENTS 4,291,933 9/1981 Kakaris .
4,834,667 5/1989 Fowler et al. .

FOREIGN PATENT DOCUMENTS

0311338A2 4/1989 European Pat. Off. .
4041629C2 5/1992 Germany .

*Primary Examiner*—Khiem Nguyen
*Attorney, Agent, or Firm*—W. G. Fasse; W. F. Fasse

[57] ABSTRACT

A two-part screw-type coupling suitable for coupling together electrical and/or mechanical components in an aircraft, for example, has a rotation lock feature that prevents the unintentional spontaneous loosening of the screwed connection as a result of vibration and shock. The coupling includes a generally cylindrical support body and a collar nut rotatably mounted thereon and retained by a retaining element. A rotation lock element locks the collar nut and the support body together against relative rotation. The lock element includes a spring or a spring-loaded ring, which is rigidly connected to the collar nut or the support body and which applies a sufficient clamping tension against the other part of the coupling to achieve the desired locking function. The rotation lock can provide a finely stepped static adjustment and locking, or a fine step-less dynamic adjustment and locking of the tightening torque of the collar nut on a component to which the coupling is screw-connected. For the stepped adjustment, a spring or a knurled ring engages a knurled surface having radial or axial knurled ridges on at least one of the two parts of the coupling. For the step-less adjustment, a spring applies a biasing torque between the two parts of the coupling.

25 Claims, 5 Drawing Sheets

SCREW-TYPE COUPLING MEMBER WITH ROTATION LOCK

FIELD OF THE INVENTION

The invention relates to a coupling member including two parts that are rotatable relative to each other, wherein relative rotation between the two parts can be locked with a rotation lock mechanism. The rotation lock mechanism prevents the screwed connection made by the coupling member from becoming unintentionally loosened as a result of external influences such as vibration. Such screw-type coupling members are used especially in the field of aircraft manufacturing for coupling together electrical lines or electromechanical lines.

BACKGROUND INFORMATION

It is generally known in the art to use a screw-type coupling member for coupling together repositionable connector cables or extension cables in carrying out electromechanical installations. Such coupling members are used to connect electrical cable runs or conduits to further electrical systems or to electrical devices or device groups. A known coupling member typically comprises a screw connection mechanism and includes suitable locking elements to secure the coupled cable connections or the connected cable terminals against unintended loosening. It is clear that a failure of such connectors is to be avoided for reasons of electrical supply reliability as well as mechanical and electrical safety, because an interruption or disconnection of the connected or interconnected components can lead to a complete system failure. For this reason, the securing mechanism of a cable protection system should protect the operational reliability of the entire system against failure as a result of unintended self-loosening of the connected components due to external mechanical influences such as vibration, for example.

Moreover, coupling members or connectors for the above described purpose are also used as an integral component of the electro-technical protective measures that are used to ensure safety against lightning strikes in aircraft. Thus, the lowest possible electrical resistance is required in the power cable junctions between the coupling elements of such components, in order not to endanger the reliability of the lightning protection measures. Conventional coupling members typically have only an inadequate securing mechanism or no securing mechanism at all for securing the coupling member against an unintended loosening or disconnection of the connected elements.

A further disadvantage of the prior art couplers is that the known securing mechanisms can only provide a coarse step-wise locking of the screwed coupling. A finely adjustable rotation lock function of the screwed connection, being tuned to the prescribed tightening torque of the screw connection, is not possible. Since the proper tightening torque cannot be achieved or reliably locked and maintained by the known coarsely-adjustable screw-type couplers, a greater electrical junction resistance will arise at the junction if the tightening torque is too low, or a mechanical overloading of the screwed connection will result if the tightening torque is too high, as necessitated by falling into one or the next coarse adjustment steps.

In the field of aircraft manufacturing, the conventional coupling members having the above criticized type of rotation lock are not adequate to meet the requirements of lightning protection. Moreover, an improper adjustment of the tightening torque of the screw connection leaves open the clearly undesirable possibility that the securing mechanism of the electrical system may become loosened or disconnected as a result of sudden external mechanical influences, which unavoidably arise in the form of vibrations, jarring shocks, etc. during take-off and landing, and even during the cruise flight of an aircraft. Moreover, such known securing mechanisms are inconvenient in their handling and installation The high reliability and safety standards imposed on the electrical supply and data transmission systems in aircraft construction require the above described problems to be solved by a coupling member that prevents any unintentional interruption or impediment of the continuing flow of electrical current through the coupled components of the cable protective system. However, the known connectors only meet the requirements of lightning protection to a limited extent.

U.S. Pat. No. 4,291,933 (Kakaris) discloses a screw-type coupling member that includes a coupling nut for coupling together an electrical plug and an electrical receptacle, and includes a locking or non-decoupling mechanism to prevent loosening of the coupling nut. The locking mechanism includes a plurality of ratchet teeth on the outer perimeter of the plug, and a spring element arranged hidden from view in two chambers within the coupling nut. The spring element reaches into and engages with the ratchet teeth, which have slanted tooth flanks, of which the steepness angle respectively sets the required adjustment force, i.e. the threshold torque required for rotating the nut. The teeth and the spring element may be constructed to provide easier rotation in the tightening direction than in the loosening direction. A visible inspection of the screw-type coupling member gives no indication whether the coupling member is in a secured condition. Furthermore, the ratchet teeth are rather large and separated by large grooves, so that they can provide only a relatively coarse rotational adjustment and locking. Thus, the coupling nut cannot be reliably tightened and locked with a precise tightening torque, whereby the local junction resistance is increased. The disclosure of U.S. Pat. No. 4,291,933 (Kakaris) is incorporated herein by reference.

German Patent 4,041,629 discloses a similar coupling member in which a springy locking element, which is connected to a collar nut by a U-shaped locking lever, reaches into and engages catch teeth provided on a bush or sleeve that forms a connector member. The catch teeth comprise run-up ramp flanks and locking flanks. The ramp flanks have a relatively low slope angle that allows the collar nut to be screwed-on, i.e. tightened relatively easily, while the locking flanks have a steep slope angle that more strongly resists rotation of the nut in the loosening direction. More particularly, the locking flanks are arranged essentially perpendicularly to a tangent of the catch area. The locking lever fixed to the locking element includes a tapered wedge tab or wedge lug extending perpendicularly therefrom and radially reaching into the catch area, i.e. the catch teeth.

In the known screw-type coupler according to German Patent 4,041,629, the rotatable connector components cannot be locked together with a defined tightening torque, so that these cylindrical components are not directly clamped or locked together in a form-locking manner. As necessitated by the spring characteristics of the locking lever that is constructively integrated into the locking mechanism, only a limited mechanical spring compression force can be produced and transmitted perpendicularly onto the circumference of the catch area. Furthermore, the toothed ridges must have a substantial ridge profile for locking together the cylindrical components, because the limited clamping force of the wedge tab would be insufficient without such relatively coarsely profiled ridges. The above described disadvantages of the construction according to U. S. Pat. No. 4,291,933 also apply to some extent here. A further disadvantage of both U.S. Pat. No. 4,291,933 and German Patent 4,041,629 is that forming the toothed ridges requires a costly and complicated cutting or milling surface treatment of the component.

U.S. Pat. No. 4,834,667 (Fowler et al.) discloses a spin coupling for electrical connectors, including a support body and a collar nut, which are held together in a rotatable manner by a spring ring retaining element. A plurality of engaging teeth having a coarse tooth pitch are provided on the inner surface of the collar nut. A detent spring is arranged with one end in a hole in a notch in the support body and with the opposite free end pressing against and engaging with the teeth of the collar nut, for locking the collar nut and the support body together against rotation. The free end of the spring is shaped to mate with the grooves between the teeth. The spring can be so constructed and arranged that a positive locking is achieved in at least one rotation direction, while detenting may be achieved in one direction. A stepped or stepless fine adjustment of the rotational locking function cannot be achieved with the described constructions of the spring and the teeth, due to the coarseness of the teeth and even due to the construction of the free end of the spring, which has a form and a size that corresponds to the coarse grooves or gaps between the teeth. In other words, the described shaped spring and the described matching shaped teeth can only be used mutually together with each other, and both require a certain degree of coarseness in the rotational adjustability. The disclosure of U.S. Pat. No. 4,834,667 (Fowler et al.) is incorporated herein by reference.

Published European Patent Application 0,311,338 discloses an arrangement for preventing inadvertent decoupling of two screw-coupled components. The arrangement includes a coupling nut rotatably mounted on an electrical connector plug, for coupling with an electrical connector receptacle. The functional locking elements include a corrugated ratchet strip bearing ratchet teeth disposed about the outer circumference of the plug, a plurality of ratchet pins distributed about an inner diameter of the coupling nut and engaging with the ratchet teeth to form a rotation lock, a ratchet retaining ring that biases the ratchet pins radially inwardly against the ratchet teeth, and various other rings. Just as the above-described prior art, this arrangement also cannot provide a step-wise or step-free fine rotation adjustment and locking of a coupling nut. More specifically, since the ratchet pins are fixed in engagement recesses between the ratchet teeth at fixed locations, i.e. at a fixed coarse circumferential spacing, using a roller principal, a fine adjustment of the coupling nut cannot be achieved, because the pins necessarily have at least a certain minimum size and require a certain minimum spacing. The disclosure of Published European Patent Application 0,311,338 is incorporated herein by reference.

OBJECTS OF THE INVENTION

In view of the above it is the aim of the invention to achieve the following objects singly or in combination:

- to provide a screw type coupling member with a rotation lock for screwed together components, having such a construction that a prescribed tightening torque of a collar nut of the coupling member can be achieved and maintained in a finely adjustable manner due to the fine step-wise or step-less adjustability of the rotation lock, or due to the application of a biasing torque by the rotation lock;
- to provide such a screw-type coupling member that achieves a low electrical junction resistance at common contact surfaces by maintaining the proper tightening torque;
- to provide such a screw-type coupling member that improves the rotation locking function of known arrangements and considerably increases the reliability of cable protective system, especially lightning protective systems, with which it can be used;
- to provide such a screw-type coupling member that reliably prevents the unintended loosening or unscrewing of the screwed together components during operation;
- to provide such a screw-type coupling member with a particular construction so that a visual inspection of the coupling member will indicate whether the coupling member is in a rotation-locked condition; and
- to provide such a screw-type coupling member with a relatively simply construction that avoids costly cutting or surface milling operations in manufacturing the coupling member components.

SUMMARY OF THE INVENTION

The above objects can be achieved in a screw-type coupling member with a rotation lock according to the invention, including a support body and a collar nut that are rotatably connected together, preferably by a spring ring retaining element. A locking element of the rotation lock secures or locks the support body and the collar nut against rotation relative to each other. The locking element is either a spring or a spring-loaded ring that is fixed relative to the collar nut or the support body. The rotation lock is constructed to allow the collar nut to be tightened and adjusted to a prescribed tightening torque with a stepwise or stepless fine adjustment of the relative rotation between the support body and the collar nut.

On the one hand, the step-wise fine adjustment is achieved by providing an enhanced grip surface, for example a knurled surface, on at least either the support body or the collar nut in such a manner that the locking element can engage with the enhanced grip surface. On the other hand, the stepless fine adjustment is achieved by pre-stressing a spring element and arranging it to apply a biasing torque between the support body and the collar nut. In the embodiment in which the enhanced grip surface provides a step-wise fine adjustment, the enhanced grip surface can be a knurled surface with knurling ridges extending parallel or perpendicular to the central axis of the coupling member. The pitch and depth of the knurling ridges and valleys is such that the free end of the locking element can engage in the knurling valleys.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figures 1, 1A, 1B:
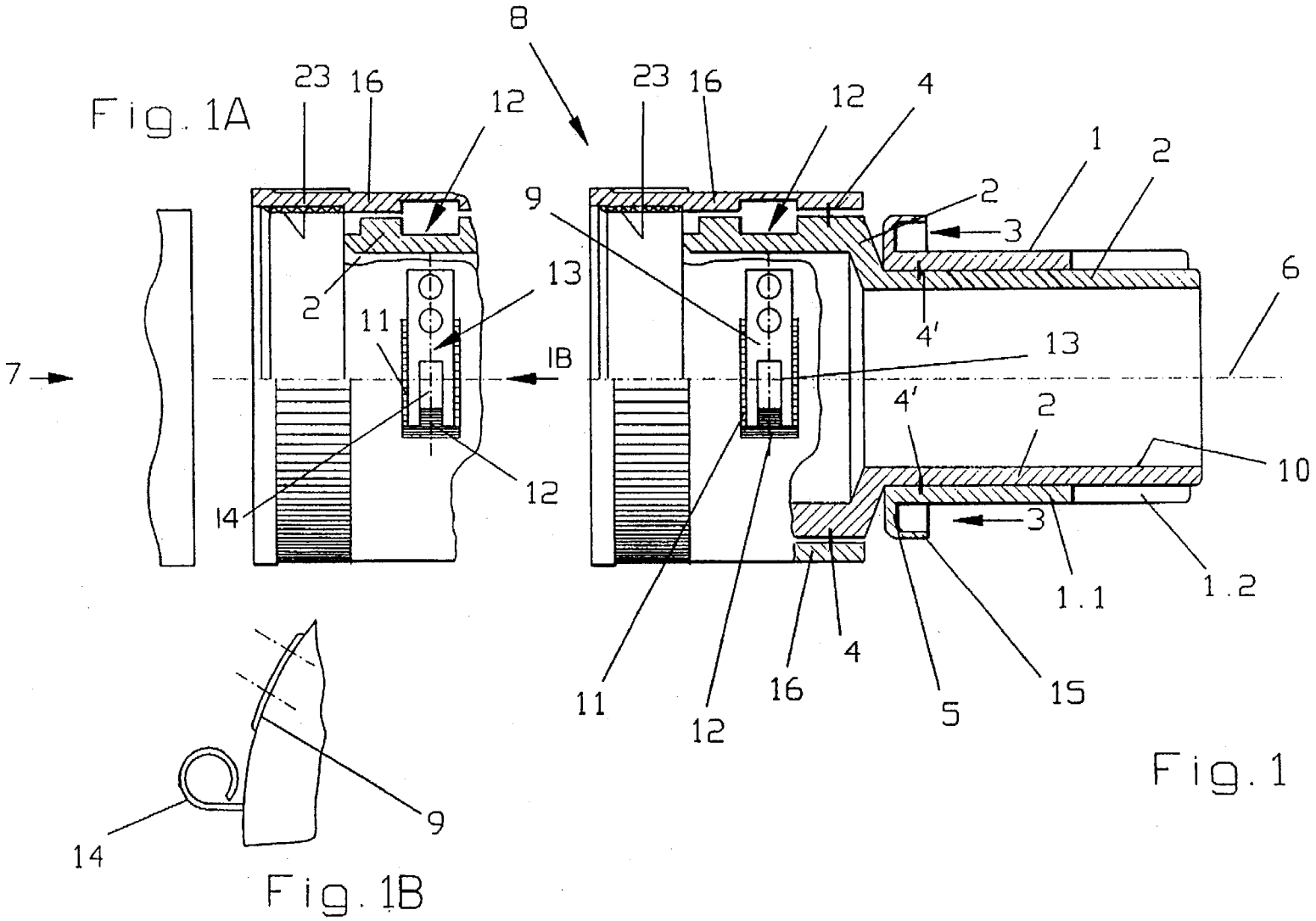
FIG. 1 is a view partially in elevation, partially in section and partially broken open, of a coupling member of a first embodiment of the invention, including a stepped support body, a collar nut, a leaf spring as a rotation locking element, and a bushing for connecting a shielding braid mounted on the stepped-down portion of the support body.
FIG. 1A shows a part of the view of FIG. 1 without the bushing, for greater simplicity.
FIG. 1B is a detail view taken in the direction of arrow IB in FIG. 1A, showing a grip tab or handle connected to the free end of the leaf spring.

FIG. 1 shows the basic construction of a two-part coupling member 8 according to a first embodiment of the invention. The coupling member 8 comprises a support body 2 and a screw=on component in the form of a collar nut 16, which are rotation symmetrically arranged about a common central axis 6 so as to be rotatable relative to one another. The two parts, namely the support body 2 and the collar nut 16, are generally each in the form of an open hollow cylindrical body respectively, and are connected together in a rotatable, but inseparable manner by a retaining element 4 in the form of a spring ring. The parts 2 and 16 are made of metal and are connected together in an electrically conducting manner by the spring ring 4. The wall of the support body 2 basically has a stepped shape, and the collar nut 16 is arranged generally bearing on the outer wall of the larger diameter portion, i.e. the portion that is not stepped-down, of the support body 2. The support body 2 and the collar nut 16 have respective mating grooves formed in the overlapping and axially closed portions of the walls of the support body 2 and the collar nut 16. The spring ring 4 is arranged vertically, i.e. in a radial plane, in the mating grooves.

The collar nut 16 serves to receive and connect the coupling 8 to a threaded electrical or mechanical component 7, which may, for example be an end housing, a junction or branch line, or an electrical plug. The component 7 to which the coupling 8 is to be connected is not shown in detail, but is merely represented schematically by a box in FIG. 1A. The inner surface of the wall of the collar nut 16 is provided with an internal threading 23, into which the component 7 can be screwed. The internal threading 23 extends from the free end of the collar nut 16 to a point near the axial end face of the larger diameter part of the support body 2. The portion of the collar nut 16 provided with the threading 23 is defined as the coupling zone.

With further reference to FIG. 1, a rotatable bushing 1 is mounted on the outer circumference of the wall of the smaller diameter portion, i.e. the stepped-down portion, of the support body 2. The bushing 1 is rotatably but inseparably connected to the support body 2 by a second spring ring retaining member 4' arranged in a groove or a mating pair of grooves formed in the support body 2 and the bushing 1. The bushing 1 generally serves to receive and connect the coupling 8 to an electrically conducting protective hose or jacket, which is not shown, in a manner that would be readily understood by persons of ordinary skill in the art. To achieve this, the bushing includes two zones, namely an axial non-slotted or solid zone 1.1 and an axially slotted zone 1.2, wherein the slots or slits are formed by electrical contact springs. A projecting collar 5, comprising a protruding flange and a protective edge 15 extending perpendicularly from the outer edge of the flange, is provided at the free end of the non-slotted or solid zone 1.1. A receiving zone 3 for receiving the conducting protective sheath is formed radially between the wall or sleeve of the bushing 1 and the protective edge 15.

As further shown in FIG. 1, an abrasion protection 10 lines the inner surface of the wall of the support body 2. The abrasion protection 10 comprises a plastic coating film applied to the inner surface of the support body 2 to protect insulated electrical cables (not shown) that are extended and guided through the support body 2 and connected with contact elements (not shown) of the component 7 to which the coupling 8 is to be connected.

Referring now to FIGS. 1 and 1A, the wall of the collar nut 16 has a recess 11 formed therein around at least a portion of the circumference thereof, at an area outside of the above described coupling zone. A certain portion of the outer surface of the wall of the support body 2 in the area adjacent and facing, i.e. directly below, the recess 11 is provided with an enhanced grip surface, which is preferably embodied as a knurled surface having knurling ridges extending parallel to the central axis 6. A locking element 9 in the form of a locking pawl or detent having a spring-biased detent tongue is rigidly attached to the collar nut 16 in the vicinity of the limited area of the recess 11, and extends perpendicularly to the central axis 6 of the coupling 8.

The locking pawl, which may suitably be a leaf spring for example, is guided and extends in the recess 11 and then engages with its pre-stressed freely movable spring shank end into the knurled surface 12, i.e. presses against the knurled surface 12. Thereby, the collar nut 16 and the support body 2 are locked together against relative rotation. The movable free end portion of the locking pawl can comprise two tongue-shaped spring shanks which engage the knurled surface 12. An advantage of the knurled surface 12 according to the invention, in comparison to a plurality of ratchet teeth, is that the knurled surface 12 may be formed more simply and economically by a pressing operation and without cutting operations, and the knurled surface can have a very small pitch spacing between adjacent knurling ridges. For that reason, the production of the coupling member is cost-economical, and a fine rotation adjustment for achieving a prescribed tightening torque of the screwed-together components is achieved. Accordingly, a static pitch- or spacing-dependent rotation lock 13 in the form of a stepwise lock is achieved, in which a stationarily fixed locking element 9 embodied as a leaf spring engages with an enhanced grip surface by means of the free movable end portion of the leaf spring reaching into and engaging with knurled grooves and ridges of the knurled surface 12 forming the enhanced grip surface.

The functional portion of the achieved rotation lock 13 relates to the locking element 9 and the enhanced grip surface, which is embodied as a knurled surface 12 having axis-parallel knurled ridges with a tight ridge pitch and sufficient knurling groove depth in order to achieve a reliable locking or securing function of the relatively rotatable parts. In order to unlock the rotationally locked parts, it is necessary to disengage the locking element 9 from the knurled surface 12. To achieve this, a pointed tool such as a screw driver, for example, can be used in the above described recess 11 of the collar nut 16 in order to pry up or lift the locking pawl, i.e. the leaf spring locking element 9, and disengage it from the gripping surface 12. In the disengaged condition, the collar nut 16 can be freely rotated relative to the support body 2.

FIG. 1A shows a portion of the coupling member 8 without showing the rotatably supported bushing 1 on the support body 2. FIGS. 1A and 1B in conjunction show a further modified arrangement for more easily disengaging the locking element 9 from the gripping surface 12. As shown, a grip tab 14, embodied as a handle tab 14 according to FIG. 1B, is connected to the rectangularly shaped cover surface of the leaf spring 9, which extends under stress perpendicularly to the central axis 6 of the coupling member 8. The grip tab 14 makes it easier to lift the one or more spring shanks of the leaf spring 9 away from the knurled surface 12 of the support body 2. The free movable part of the leaf spring 9 is, for example, embodied to have two spring shanks or legs, as shown in FIGS. 1 and 1A. The grip tab 14, which is located within the visible portion of the spring shanks, manually disengages the free end of the one or more spring shanks of the leaf spring 9 out of the knurled surface 12.

Figures 2, 2A, 2B:
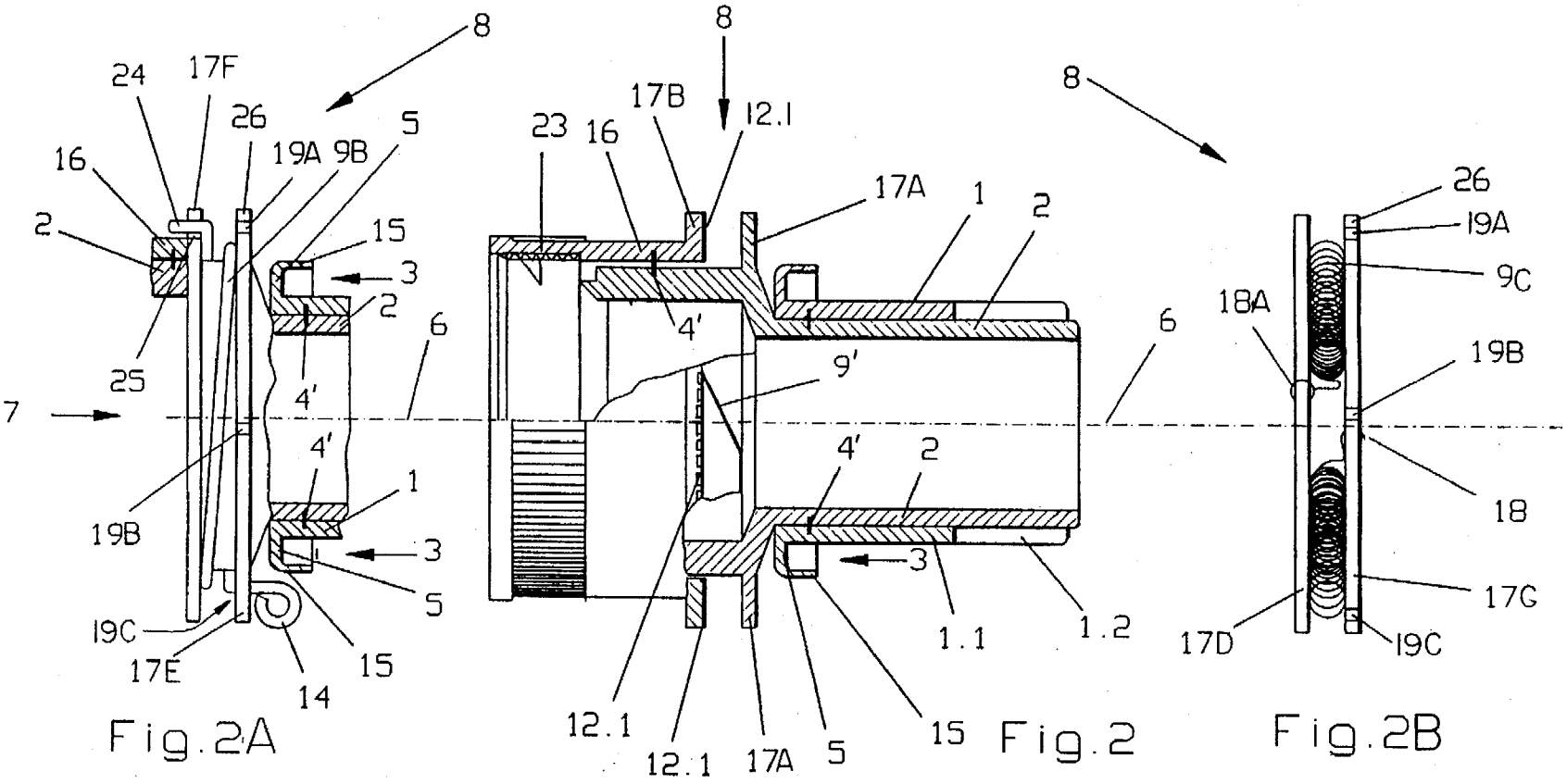
FIG. 2 is a view partially in elevation, partially in section and partially broken open, of a coupling member of a second embodiment of the invention, having flanges on the support body and on the collar nut, and a leaf spring arranged between the facing annular surfaces of the flanges
FIG. 2A is a partial view of a variant of the coupling member of FIG. 2, having a torsion spring arranged between the two flanges in order to produce a biasing torque for the rotation locking function.
FIG. 2B is a partial view of a further variant of the arrangement of FIG. 2, having extension spring arranged between the two flanges for producing a counter torque for the rotation locking function.

FIG. 2 shows a different embodiment of the coupling member 8. The coupling member 8 according to FIG. 2 includes a support body 2 and a screw-on part 16 embodied as a collar nut 16, and a bushing 1 rotatably supported on the support body 2, generally similarly to the embodiment of FIG. 1. However, in contrast to the embodiment of FIG. 1, a radially protruding flange 17A is formed on the support body 2 on the larger diameter portion thereof, directly adjacent the step-down shoulder thereof, and a second flange 17B protrudes radially from the free end of the collar nut 16 near the flange 17A and outside of the above described coupling zone. The two flanges 17A and 17B have radial annular surfaces that axially face one another across a small spacing gap between the two flanges 17A and 17B. The annular surface of the flange 17B of the collar nut 16 is provided with a knurled surface 12.1 having radial knurling ridges. A locking element in the form of a leaf spring 9' is arranged between the mutually facing surfaces of the two flanges 17A and 17B, wherein the spring 9' is rigidly secured to the flange 17A and a free end of the spring 9' engages with the knurled surface 12.1 on the flange 17B.

Thus, the pre-stressed free spring shank end of the spring 9' is pressed axially against the knurled surface 12.1, so as to lock the collar nut 16 and the support body 2 together against relative rotation. In order to unlock the collar nut 16 to allow its rotation relative to the support body 2, the free spring shank of the leaf spring 9' must be lifted to disengage it from the knurled surface 12.1 of the flange 17B of the collar nut 16. The achieved rotation lock 13, comprising the leaf spring 9' engaged with and locked into the knurled surface 12.1, is a static rotation lock, like the embodiment of FIG. 1. The distinction between a static lock and a dynamic lock will be described below.

FIG. 2A is a detail view of a portion of a coupling member 8 similar to that of FIG. 2, but in a further modified embodiment to provide a dynamic rotation lock 13. More specifically, herein a flange 17E radially protrudes from the support body 2 and a flange 17F radially protrudes from the collar nut 16. Neither of the flanges 17E and 17F includes a knurled grip surface. Instead, the flange 17E includes a plurality of notches 19A, 19B, and 19C along its outer edge, and flange 17F includes a hole 25 passing through the flange near its outer edge, for receiving a locking element in the form of a shank spring 9B that is arranged circumferentially around the support body 2 between the two flanges 17E and 17F. The shank spring 9B comprises a combination of a compression spring with two spring shanks. One shank of the spring 9B includes an axially extending protruding nose 24 that is secured in the hole 25 of the flange 17F. The spring 9B presses axially against the flange 17E and 17F so that the nose 24 is held securely in the hole 25. The other spring shank of the spring 9B is provided with a grip tab 14 that is engaged in a selected one of plural catches 26 that respectively extend from and adjacent to each notch 19A, 19B, 19C, after the collar nut 16 has been screwed with the desired tightening torque onto the component 7 that is to be coupled.

The dynamic rotation lock 13 formed in this manner provides a zero-pitch, i.e. step-less, fine adjustment of the screwed connection between the parts. In this context, the term "dynamic" rotation lock means that the spring 9B exerts a prescribed biasing torque in the tightening direction onto the collar nut 16 relative to the support body 2 during operation. In other words, once the collar nut 16 is screwed onto the component 7 with the desired tightening torque, the spring 9B is engaged in the selected notch 19A, 19B, 19C so that the spring nose 24 in the hole 25 of the flange 17F applies and maintains a spring biased torque in the tightening direction to the collar nut 16. In this context, it is especially advantageous that a reduction of the tightening torque of the screwed-together components during operation is kept as small as possible. Moreover, the loosening torque that can arise during relative motion of the components is blocked or prevented by the counter-acting biasing torque. In this manner, the screwed together components are secured against loosening. In order to intentionally loosen or decouple the coupling member 8, the grip tab 14 is manually lifted and removed out of the catch 26 of the selected slot 19A, 19B, 19C, whereupon the counter-biasing torque is removed and the collar 15 nut 16 can be loosened.

FIG. 2B shows a further variant of a coupling member 8, which is generally similar to that of FIG. 2A and also has the similar characteristic that it provides a dynamic biasing torque. However, instead of a shank spring 9B as in FIG. 2A, the embodiment of FIG. 2B uses a tension spring 9C arranged to extend around the circumference of the support body 2 between two flanges 17C and 17D that are not provided with knurled surfaces. The flange 17C includes a plurality of notches 19A, 19B, and 19C with corresponding catches 26 for receiving a hook 18 at one end of the tension spring 9C. The flange 17D includes a hole for undetachably receiving a hook or eyelet 18A at the other end of the tension spring 9C. Thus, the tension spring 9C extends circumferentially around the support body 2 and is guided between the flanges 17C and 17D, whereby the spring 9C applies a radially inwardly directed force onto the support body 2 and applies a circumferentially directed bias torque between the two flanges 17C and 17D. Thereby, the tension spring 9C applies a biasing torque to the collar nut 16 after the collar nut 16 has been screwed onto the component 7 with the desired tightening torque and the hook 18 of the spring 9C has been hooked into the selected notch 19A, 19B or 19C, so as to provide a fine stepless adjustment of the tightening torque and a dynamic rotation locking function. In order to release the rotation lock of the screwed-together components, the hook 18 is manually removed from the selected notch 19A, 19B or 19C, whereby the biasing torque is removed and the collar nut 16 may be loosened.

Figure 3:
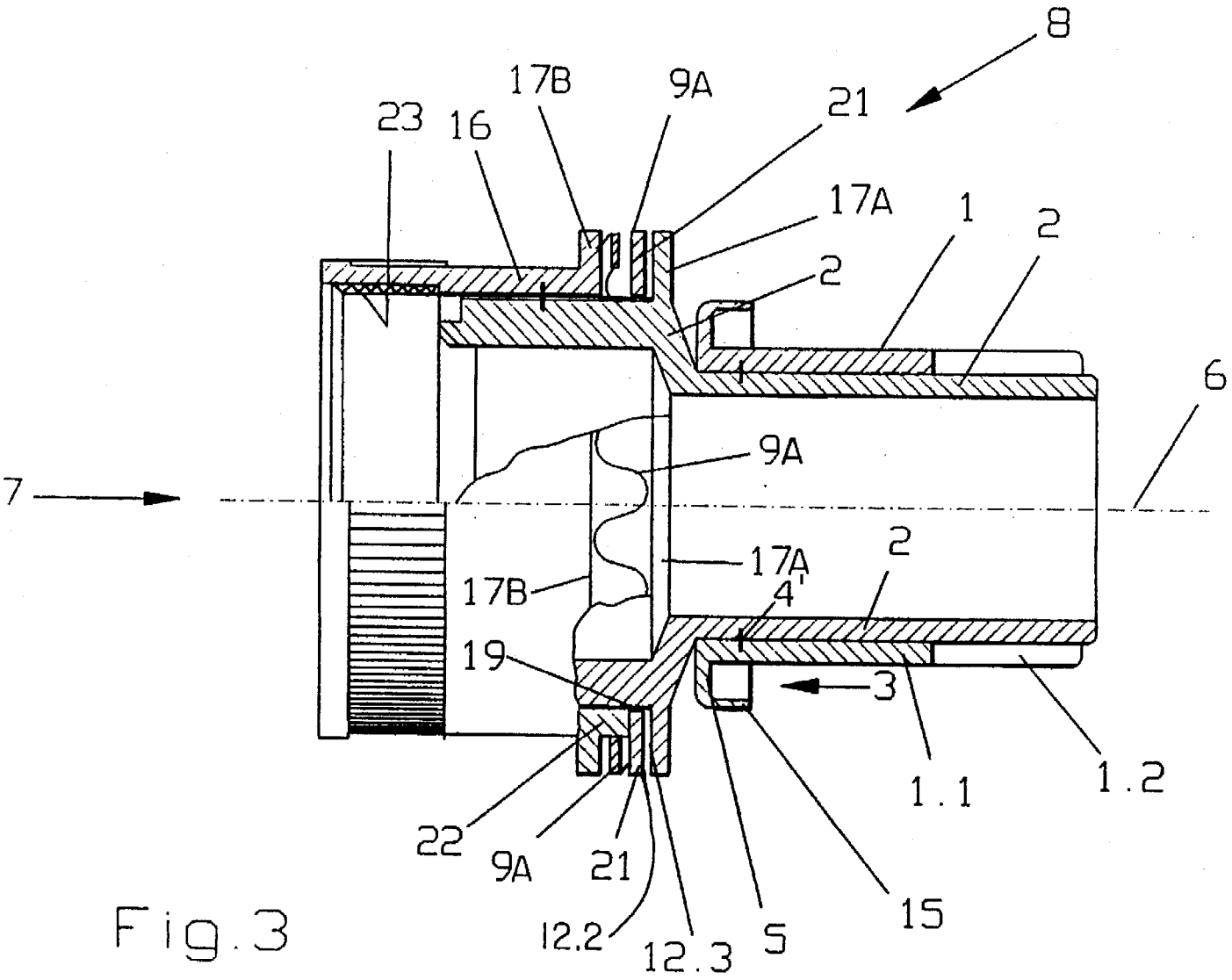
FIG. 3 is a view similar to that of FIG. 2, but showing a further variant arrangement, including a wave spring washer arranged between the two flanges to press a locking ring against an annular face of one flange.

FIG. 3 shows a further modified embodiment of a rotation lock arrangement 13 according to the invention, including a locking element embodied as a spring loaded ring. Similar to the embodiment of FIG. 2, respective flanges 17A and 17B protrude radially from the support body 2 and the collar nut 16. A pre-stressed corrugated spring ring 9A axially presses an axially movable ring 21 between the two flanges 17A and 17B. The axial space between the two flanges 17A and 17B is radially outwardly open. With the illustrated arrangement, the corrugated spring ring 9A presses the movable ring 21 axially against the annular surface of the flange 17A of the support body 2. The annular surface of the ring 21 facing the flange 17A is provided with a radially arranged knurling 12.2, and the facing annular surface of the flange 17A is provided with a corresponding radial knurling 12.3.

At least one claw 22 axially extends from the annular surface of the flange 17B of the collar nut 16 and engages with a slot or notch 19 provided in the ring 21, so that the ring 21 is coupled to the collar nut 16 so as to rotate together therewith. Since the corrugated spring ring 9A normally urges the ring 21 with its knurled surface 12.2 against the knurled surface 12.3 of the flange 17A, the ring 21 engages with the flange 17A, and thereby due to the connection of the screwed-together components, the parts of the coupling member 8 are locked against relative rotation.

The increased surface friction between the knurled surfaces 12.2 of the ring 21 and 12.3 of the flange 17A requires an increased loosening moment to be overcome, whereby an unintentional self-loosening of the collar nut 16 during operation is prevented. The frictional force between the knurled surfaces 12.2 and 12.3 can be manually overcome by applying a sufficient loosening torque to the collar nut 16, or the rotation locking engagement can be released by pressing the ring 21 away from the flange 17A against the force of the corrugated spring ring 9A. This can be achieved with a tool, such as a screwdriver, or by suitable grip tabs (not shown) arranged on the ring 21.

Figure 4:
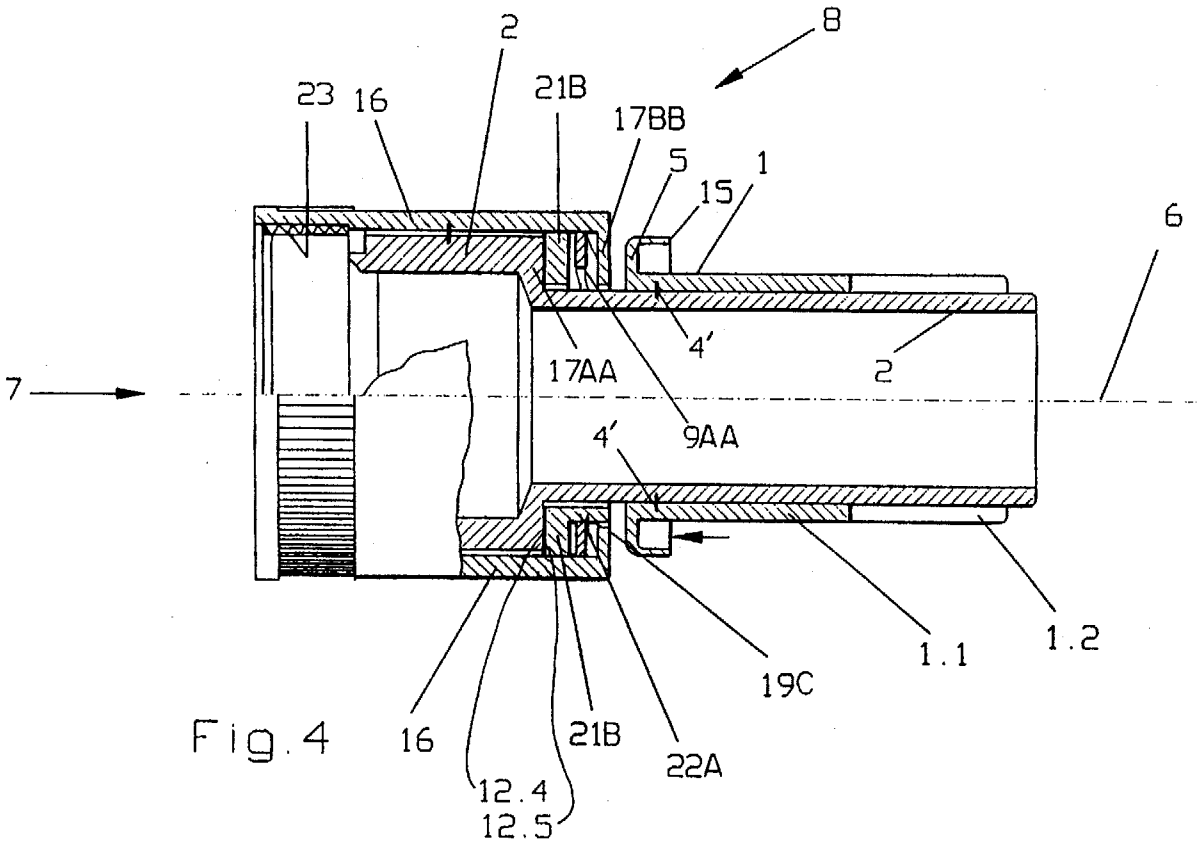
FIG. 4 shows a further embodiment of a coupling member, including a stepped support body and a collar nut having a radially inwardly directed flange, and a wave spring washer arranged between the flange and the stepped-down shoulder of the support body to press a locking ring against the stepped-down shoulder.

FIG. 4 shows a further embodiment of a coupling member 8 according to the invention. Similarly to the above described embodiments, the present coupling member 8 includes a collar nut 16 rotatably arranged on a support body 2, which includes a larger diameter portion that is stepped down through a shoulder to a smaller diameter portion. The stepped-down shoulder forms a flange surface 17AA that is provided with a radial knurling 12.4. A bushing 1 is rotatably mounted on the smaller diameter portion of the support body 2, in the manner described above. The collar nut 16 includes a radially inwardly extending flange 17BB received generally between the flange surface 17AA of the stepped-down shoulder and the bushing 1. The flange 17BB is not provided with a knurled surface.

A ring 21B and a pre-stressed corrugated spring ring 9AA are arranged between the flange 17BB and the stepped-down shoulder flange surface 17AA so that the spring ring 9AA presses the ring 21B against the flange 17AA. The annular surface of the ring 21B facing the flange 17AA is provided with a knurling 12.5 that faces, contacts, and engages with the knurling 12.4 of the flange surface 17AA. Thus, a locking element is provided in the form of a spring loaded ring comprising the corrugated spring ring 9AA and the ring 21B. The ring 21B includes at least one claw or nub 22A projecting therefrom, and the flange 17BB of the collar nut 16 has at least one slot or notch 19C formed therein to receive and engage the claw 22A. Thus, the ring 21B is coupled to the collar nut 16 to rotate therewith.

Since the knurled surface 12.4 of the flange 17AA and the knurled surface 12.5 of the ring 21B are pressed against one another and thus engage one another, once the collar nut 16 is screwed onto the component 7 to which it is to be coupled, the two parts of the coupling member 8, namely the collar nut 16 and the support body 2, are locked together against relative rotation. Thus, a static rotation lock of the screwed-together components is achieved by means of increased frictional forces as follows. The pressing together engagement of the knurled surfaces 12.4 and 12.5 requires an increased loosening torque to overcome, whereby an unintended and spontaneous loosening of the collar nut 16 during operation is prevented. The ring can be pulled back, i.e. disengaged from the flange knurling, in the manner described above, to unlock the coupling member to allow rotation.

Figure 5:
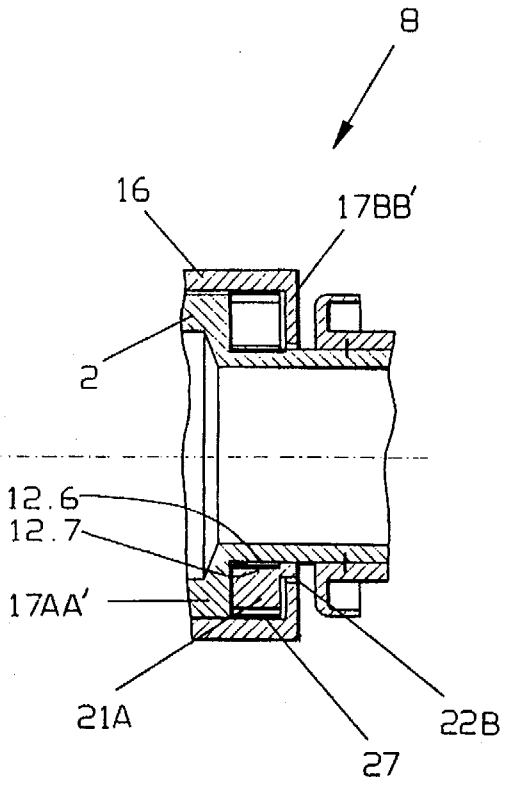
FIG. 5 is a partial view of a variant of the arrangement of FIG. 4, wherein a wave spring ring presses a split locking ring radially inwardly against the support body.

FIG. 5 is a partial view of a coupling member 8 that is generally similar to the coupling member shown in FIG. 4, with certain modifications. The collar nut 16 includes a radially inwardly extending flange 17BB', and the stepped-down shoulder of the support body 2 includes a flange surface 17AA'. The embodiment of FIG. 5 does not include the ring 21B and the spring ring 9AA of FIG. 4, but instead includes a split ring 21A and a radial limited corrugated spring ring 27 circumferentially around the split ring 21A in the space between the flange 17B and the flange 17A. A claw or nub 22B protrudes from the ring 21A through a hole or notch in the flange 17BB', so that the ring 21A is coupled to the flange 17BB' so as to rotate together with the collar nut 16.

The inner cylindrical surface of the split ring 21A is provided with a knurling 12.7 with knurling ridges running parallel to the central axis 6. A cylindrical outer surface of the support body 2 is provided with a mating knurling 12.6. The corrugated spring ring 27 presses the split ring 21A radially inwardly so that its knurling 12.7 presses against and engages the knurling 12.6 of the support body 2, which thereby achieves a rotation locking function. Thus, in the present embodiment, the locking element has the form of a radially spring-loaded ring comprising the corrugated spring ring 27 and the split ring 21A. A pre-stressed split ring 21A, which by itself includes a radial spring characteristic, would serve the same purpose even without the corrugated spring ring 27.

Figure 6:
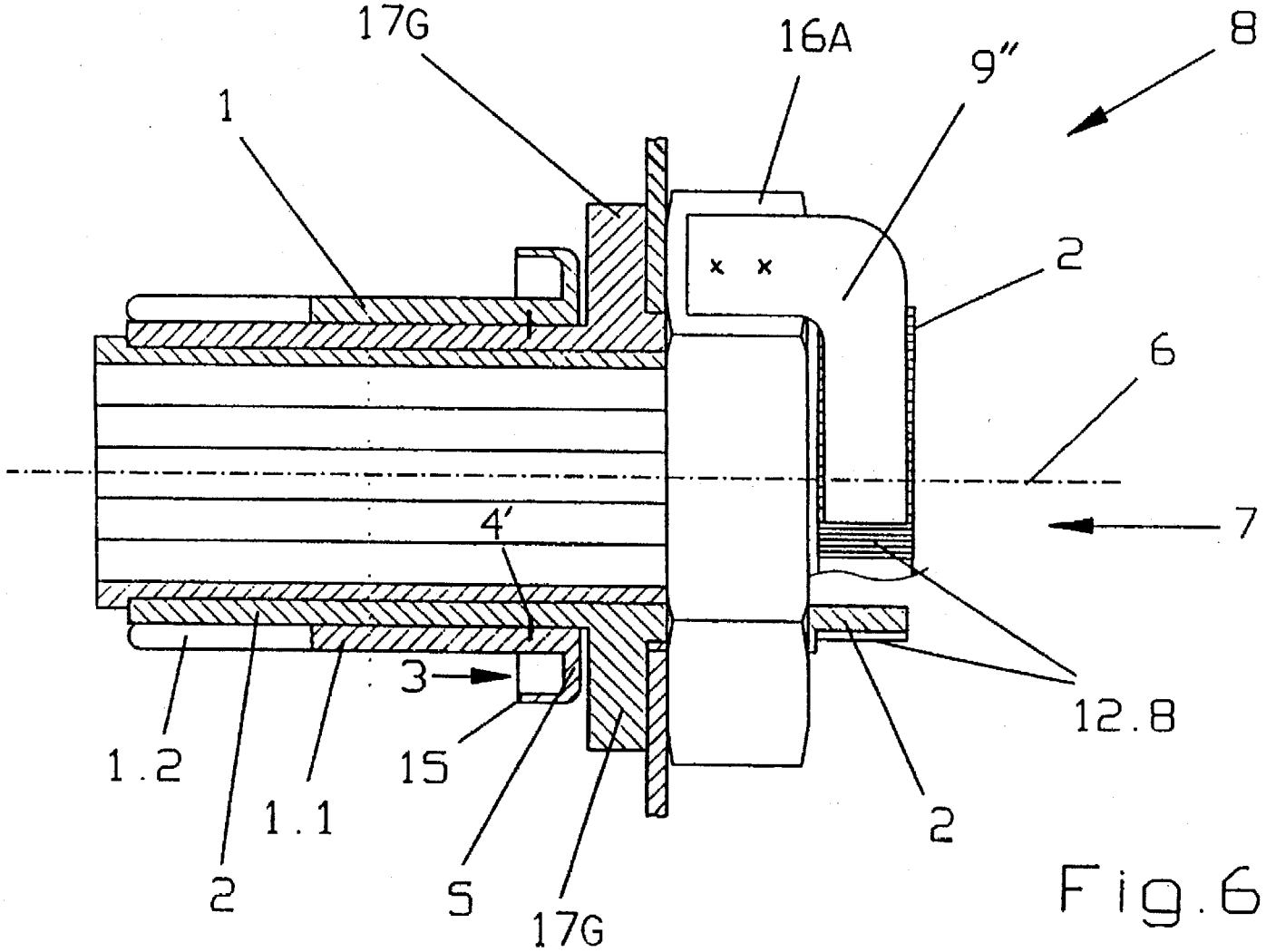
FIG. 6 is a view partially in elevation and partially in section, of a further embodiment of a coupling member, including a support body with a flange and a hex nut that can be tightened onto the support body close to the flange, wherein an L-shaped leaf spring is attached to the hex nut as a locking element.

FIG. 6 shows another embodiment of a coupling member 8 according to the invention for locking screwed-together components against rotation. The present coupling member 8 comprises a substantially cylindrical support body 2 having a radially protruding flange 17G, and a screw-on member in the form of a hex nut 16A that is rotatably mounted on an axially extending end of the support body 2. In its screwed-on condition, the hex nut 16A is located on the support body 2 near the flange 17G. An end of the support body 2 protruding out beyond the hex nut 16A is provided on its outer circumference with a knurling 12.8 including a plurality of knurled ridges extending parallel to the central axis 6. A bushing 1 is rotatably mounted on the opposite end of the support body 2, in the manner described above.

The locking element 9" essentially comprises an L-shaped leaf spring, of which one shank end is rigidly fixed on the outer perimeter of the hex nut 16A. The tapered opposite shank of this pre-stressed L-shaped leaf spring 9" is freely movable and reaches into and engages the knurling 12.8 provided on the protruding end of the support body 2. With this construction, the spring 9" serves to lock together the hex nut 16A and the support body 2 against relative rotation.

As described above, a coupling member according to the invention can provide either a fine-stepped adjustment or a fine step-less adjustment of the rotation of the collar nut 16, and can then lock the rotational position of the collar nut 16 with such a fine adjustability. As an example, it is noted that the embodiments according to FIGS. 1, 1A, 1B, 2, 3, 4, 5, and 6 provide a fine-stepped static adjustment and locking of the rotational lock 13, while the embodiments of FIGS. 2A and 2B provide a step-less fine adjustment and dynamic rotational lock 13.

Although the invention has been described with reference to specific example embodiments, it will be appreciated that it is intended to cover all modifications and equivalents within the scope of the appended claims.

What is claimed is:

1. A coupling member comprising a substantially cylindrical support body, a collar nut rotatably arranged coaxially on said support body about a central axis thereof, and a rotation lock mechanism arranged to at least selectively resist relative rotation of said collar nut on said support body;

wherein said rotation lock mechanism is selected from:

a first mechanism that allows a fine step-less rotational adjustment between said collar nut and said support body, and that comprises a spring element connected and arranged to apply a counter torque between said collar nut and said support body; and a second mechanism that allows a fine step-wise rotational adjustment between said collar nut and said support body, and that comprises on said collar nut or said support body a first knurled engagement surface having knurling ridges extending parallel or perpendicular to said central axis, and comprises lock element that presses against and engages with said first knurled engagement surface;

wherein said lock element is selected from:

a first lock element comprising a spring element that is fixed to said support body or said collar nut and that has a free end that engages with said first knurled engagement surface; and a second lock element comprising a spring-biased ring having a second knurled surface adapted and urged by a spring-bias to engage said first knurled engagement surface.

2. The coupling member of claim 1, further comprising a retaining ring connecting said collar nut and said support body to allow rotation and not allow axial motion therebetween.

3. The coupling member of claim 1, wherein said knurling ridges have a groove depth and spacing pitch defining said fine step-wise adjustment and adapted to engage with said lock element.

4. The coupling member of claim 1, wherein said rotation lock mechanism is said second mechanism, said first knurled engagement surface is provided on a cylindrical circumferential surface of said collar nut or said support body, said knurling ridges extend parallel to said central axis, and said lock element is said first lock element.

5. The coupling member of claim 4, wherein said collar nut has a recess on an inner cylindrical circumferential surface thereof, said spring element of said first lock element is fixed to said collar nut and guidingly held in said recess, and said first knurled engagement surface is provided on an outer circumferential surface of said support body facing said recess.

6. The coupling member of claim 5, wherein said free end of said spring element includes two parallel spring fingers that each respectively engage with said first knurled engagement surface.

7. The coupling member of claim 5, further comprising a grip tab connected to said spring element and adapted to disengage said free end of said spring element from said first knurled engagement surface when said grip tab is in a manually lifted position.

8. The coupling member of claim 4, wherein said collar nut is a hex nut, said spring element of said first lock element is a leaf spring including first and second spring legs arranged in an L-shape, said first knurled engagement surface is provided on an outer circumferential surface of said support body adjacent said hex nut, said first spring leg is rigidly fixed to said hex nut and said second spring leg has said free end, which is prestressed to engage with said first knurled support surface.

9. The coupling member of claim 1, wherein said rotation lock mechanism is said second mechanism, said lock element is said first lock element comprising said spring element, said support body includes a cylindrical sleeve portion and a first annular flange extending radially therefrom, said collar nut includes a cylindrical sleeve portion and a second annular flange extending radially therefrom, said first and second flanges respectively have first and second annular surfaces facing each other, said first knurled engagement surface is provided on one of said first and second annular surfaces and said spring element is fixed on the other of said first and second annular surfaces and arranged between said first and second flanges, and said knurling ridges extend radially and perpendicularly to said central axis.

10. The coupling member of claim 9, wherein said first knurled engagement surface is provided on said second annular surface of said second flange, and said spring element is fixed on said first annular surface of said first flange.

11. The coupling member of claim 1, wherein said rotation lock mechanism is said second mechanism, said lock element is said second lock element comprising said spring-biased ring and further comprising a biasing spring therefor, said support body includes a cylindrical sleeve portion and a first annular flange extending radially therefrom, said collar nut includes a cylindrical sleeve portion and a second annular flange extending radially therefrom, said first and second flanges respectively have first and second annular surfaces facing each other, said first and second annular surfaces include a knurled annular surface with said first knurled engagement surface provided thereon and a non-knurled annular surface that is not provided with said knurled engagement surface, said knurling ridges extend radially and perpendicularly to said central axis, said ring of said second lock element is arranged between said first and second flanges with said second knurled surface facing said first knurled engagement surface, said spring of said second lock element is arranged between said ring and said non-knurled annular surface, and said ring is coupled to said annular flange having said non-knurled annular surface so as to positively rotate therewith and allow axial movement relative thereto.

12. The coupling member of claim 11, wherein said spring is a wave spring washer.

13. The coupling member of claim 11, wherein said annular flange having said non-knurled annular surface has a claw protruding axially therefrom, and said ring has an axially directed hole receiving said claw axially slidably therein.

14. The coupling member of claim 13, wherein said first annular surface of said first annular flange is said knurled annular surface, and said second annular flange has said claw protruding axially therefrom.

15. The coupling member of claim 11, wherein said annular flange having said non-knurled annular surface has an axially directed hole, and said ring has a claw protruding axially therefrom which is axially slidably received in said axially directed hole.

16. The coupling member of claim 15, wherein said first annular surface of said first annular flange is said knurled annular surface, and said second annular flange has said axially directed hole therein.

17. The coupling member of claim 11, wherein said second annular flange extends radially inwardly from said cylindrical sleeve portion of said collar nut, said cylindrical sleeve portion of said support body includes a larger diameter portion and a smaller diameter portion with a stepped-down shoulder between said larger and smaller diameter portions, and said stepped-down shoulder forms said first annular flange.

18. The coupling member of claim 1, wherein said rotation lock mechanism is said second mechanism, said lock element is said second lock element, said support body includes a larger diameter sleeve portion and a smaller diameter sleeve portion with a stepped-down shoulder therebetween, said collar nut includes a cylindrical sleeve portion that extends axially over said larger diameter sleeve portion and said stepped-down shoulder, and includes a flange extending radially inwardly from said cylindrical sleeve portion with an annular space formed between said shoulder and said flange, said first knurled engagement surface is formed on an outer circumferential surface of said smaller diameter sleeve portion of said support body in said annular space, said knurling ridges extend parallel to said central axis, said ring of said second lock element is a split ring with said second knurled surface provided on an inner circumferential surface thereof with second knurling ridges extending parallel to said central axis, and said split ring is arranged in said annular space with said second knurled surface urged into contact with said first knurled engagement surface.

19. The coupling member of claim 18, where in second lock element further comprises a wave spring washer arranged in said annular space radially outside and circumferentially around said split ring to urge said split ring into contact with said first knurled engagement surface.

20. The coupling member of claim 18, wherein said split ring includes a claw protruding axially therefrom, and said flange has an axially directed hole therein which axially slidably receives said claw, to couple said split ring and said flange for mutual rotation and allow relative axial sliding therebetween.

21. The coupling member of claim 1, wherein said rotation lock mechanism is said first mechanism, said support body includes a cylindrical sleeve portion and a first annular flange extending radially therefrom, said collar nut includes a cylindrical sleeve portion and a second annular flange extending radially therefrom with an annular space between said first and second annular flanges, said spring element of said first rotation lock mechanism has two ends respectively provided with an attachment part selected from the group consisting of a hook, an eyelet and a grip tab, said first and second flanges each have a spring attachment hole therein, and said spring element is arranged in said annular space between said flanges and extends around at least a portion of an outer circumference of said cylindrical sleeve portion of said support body with said attachment part at one end of said spring engaged in said attachment hole of said first flange and said attachment part at another end of said spring engaged in said attachment hole of said second flange.

22. The coupling member of claim 21, wherein said first flange has a plurality of said attachment holes respectively in the form of a notch at a rim of said first flange with a catch recess at a bottom of said notch, and wherein said attachment part of said spring to be engaged in said attachment hole of said first flange can be engaged in any selected one of said plural holes of said first flange.

23. The coupling member of claim 22, wherein said spring element is a extension spring arranged with a spring axis of plural coils thereof extending circumferentially around least a portion of said outer circumference of said support body.

24. The coupling member of claim 22, wherein said spring element is a torsion spring having two shanks at opposite ends of a spring coil arranged with a spring axis thereof extending coaxially with said central axis.

25. The coupling member of claim 24, wherein said attachment part to be engaged in said attachment hole of said first flange is said grip tab.

* * * * *

UNITED STATES PATENT AND TRADEMARK OFFICE
CERTIFICATE OF CORRECTION

PATENT NO. : 5,674,087

DATED : Oct. 7, 1997

INVENTOR(S) : Kirma

It is certified that error appears in the above-identified patent and that said Letters Patent is hereby corrected as shown below:

On the Title Page:
In [75] replace "Holstein, Germany" by --Wedel/Holstein, Germany--.

Col. 5, line 5, after "flanges" insert --;--
line 11, after "having" insert --a--.
line 41. replace "screw=on" by --screw-on--.

Col. 8. line 51, delete "15".

Co' 11, line 45, after "comprises" insert --a--.

Col. 1 line 38, after "plural" insert --attachment--.

Signed and Sealed this

Twenty-seventh Day of January, 1998

*Attest:*

Bruce Lehman

BRUCE LEHMAN

*Attesting Officer*

*Commissioner of Patents and Trademarks*